US008147016B2

(12) United States Patent
Kwon

(10) Patent No.: US 8,147,016 B2
(45) Date of Patent: Apr. 3, 2012

(54) CAN RECEIVING APPARATUS AND REFRIGERATOR HAVING THE SAME

(75) Inventor: Youl Kwon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 805 days.

(21) Appl. No.: 12/179,310

(22) Filed: Jul. 24, 2008

(65) Prior Publication Data

US 2009/0026162 A1 Jan. 29, 2009

(30) Foreign Application Priority Data

Jul. 27, 2007 (KR) ..... 10-2007-0075570

(51) Int. Cl.
*A47B 96/04* (2006.01)

(52) U.S. Cl. ..... 312/405.1; 312/321.5

(58) Field of Classification Search ..... 312/405.1, 312/405, 321.5, 72, 73; 206/759, 755, 749; 211/74, 75, 59.2, 87.01; 108/6; 220/810; 221/65, 188

See application file for complete search history.

(56) References Cited

U.S. PATENT DOCUMENTS 2,793,387 A * 5/1957 Odell ..... 16/358
3,123,220 A * 3/1964 Hanson ..... 211/88.01
4,167,298 A * 9/1979 Plattner ..... 312/290
4,186,978 A * 2/1980 Thomson ..... 312/321.5
4,194,647 A * 3/1980 Spurrier ..... 221/97
4,454,949 A * 6/1984 Flum ..... 211/59.2
4,531,646 A * 7/1985 Howard ..... 211/150
4,776,457 A * 10/1988 Ferraroni ..... 206/45.23
4,852,213 A * 8/1989 Shewchuk ..... 16/266
5,125,518 A * 6/1992 Ward ..... 211/87.01
5,169,221 A * 12/1992 Wheeler ..... 312/323
5,513,910 A * 5/1996 Ellingwood et al. ..... 312/405.1
6,006,926 A * 12/1999 O'Reilly et al. ..... 211/45
6,126,257 A * 10/2000 Carpenter et al. ..... 312/9.44
6,234,345 B1 * 5/2001 Minh et al. ..... 221/124
6,513,667 B2 * 2/2003 Battaglia et al. ..... 211/59.2
6,694,771 B2 * 2/2004 Kim et al. ..... 62/465
6,786,341 B2 * 9/2004 Stinnett et al. ..... 211/59.2
6,799,818 B2 * 10/2004 Ahmed et al. ..... 312/405.1
6,862,896 B1 * 3/2005 Seidl ..... 62/457.4
6,908,163 B1 * 6/2005 Hebeler et al. ..... 312/405.1
7,377,123 B2 * 5/2008 Byrne et al. ..... 62/378

(Continued)

FOREIGN PATENT DOCUMENTS

EP 1030141 A2 * 8/2000

(Continued)

OTHER PUBLICATIONS

English translation of KR10-2005-0051324, Jun. 1, 2005.*

(Continued)

*Primary Examiner* — Darnell M Jayne
*Assistant Examiner* — Hiwot Tefera
(74) *Attorney, Agent, or Firm* — Birch, Stewart, Kolasch & Birch, LLP

(57) ABSTRACT

A can receiving apparatus is disclosed. More particularly, disclosed is a can receiving apparatus for a refrigerator, in which a can receiving shelf is conveniently fixed at a pivotally rotated position, assuring easy storage and removal of cans and improved space utility. The can receiving apparatus includes a case, a can receiving shelf coupled to the case in a pivotally rotatable manner, and a fixing structure to fix the can receiving shelf at an upper limit position upon pivotal rotation of the can receiving shelf.

22 Claims, 7 Drawing Sheets

U.S. PATENT DOCUMENTS

| | | | | |
|---|---|---|---|---|
| 7,472,974 | B2 * | 1/2009 | Czach et al. | 312/405.1 |
| 7,536,752 | B2 * | 5/2009 | Laursen | 16/358 |
| 7,552,983 | B2 * | 6/2009 | Shin | 312/405.1 |
| 7,866,181 | B2 * | 1/2011 | Lee et al. | 62/344 |
| 2002/0117947 | A1 * | 8/2002 | Cheng | 312/327 |
| 2003/0024265 | A1 * | 2/2003 | Winders et al. | 62/440 |
| 2003/0080661 | A1 * | 5/2003 | Ahmed et al. | 312/405.1 |
| 2004/0012314 | A1 * | 1/2004 | Hay et al. | 312/405.1 |
| 2004/0178711 | A1 * | 9/2004 | Avendano | 312/405.1 |
| 2005/0116596 | A1 * | 6/2005 | Leimkuehler et al. | 312/405.1 |
| 2006/0016210 | A1 * | 1/2006 | Lee et al. | 62/408 |
| 2008/0246381 | A1 * | 10/2008 | Kim | 312/405.1 |
| 2009/0033191 | A1 * | 2/2009 | Kim | 312/405.1 |
| 2009/0255089 | A1 * | 10/2009 | Boonmatun | 16/231 |
| 2010/0270902 | A1 * | 10/2010 | Kim et al. | 312/405.1 |
| 2010/0283368 | A1 * | 11/2010 | Lee | 312/405.1 |

FOREIGN PATENT DOCUMENTS

| | | | |
|---|---|---|---|
| JP | 5-36285 | U | 5/1993 |
| KR | 10-2002-0057633 | A | 7/2002 |
| KR | 10-2005-0051324 | A | 6/2005 |
| KR | 10-2006/0002558 | A | 1/2006 |
| WO | WO 2008028266 | A1 * | 3/2008 |

OTHER PUBLICATIONS

English translation of KR 10-2002-0057633.*

* cited by examiner

CAN RECEIVING APPARATUS AND REFRIGERATOR HAVING THE SAME

This application claims the benefit of the Korean Patent Application No. P2007-0000000, filed on, 2007, which is hereby incorporated by reference as if fully set forth herein.

BACKGROUND OF THE INVENTION

1. Field of the Invention

The present invention relates to a can receiving apparatus and a refrigerator having the same, and more particularly, to a can receiving apparatus for a refrigerator, in which a can receiving shelf can be fixed at an upper-limit position or a lower-limit position upon pivotal rotation thereof, achieving an improvement in space utility and workability.

2. Discussion of the Related Art

Generally, a refrigerator is devised to store food at low temperatures. According to desired storage requirements of food, the refrigerator stores food at a refrigerating temperature or freezing temperature. Cold air fed into the refrigerator is produced via heat-exchange of a refrigerant.

Specifically, the refrigerant is continuously circulated in the refrigerator while repeatedly undergoing a cycle of compression, condensation, expansion and evaporation. With heat exchange between the refrigerant and air inside the refrigerator, cold air can be produced. As the produced cold air is uniformly transmitted within the refrigerator by convection, food stored in the refrigerator can be maintained at desired temperatures.

A refrigerator body includes a freezing compartment in which food is stored at a freezing temperature, and a refrigerating compartment in which food is stored at a refrigerating temperature. A partition wall separates the freezing compartment from the refrigerating compartment. According to the shape of products, door(s) are provided at front left and/or right sides of the refrigerator body.

Of foods to be stored, ones received in cans or bottles, eggs, and the like are generally stored by use of door baskets provided at an inner surface of the refrigerator door. However, the door baskets may have a limited receiving space.

In addition to a basic storage function, recently, refrigerators have been developed to have certain extra functions according to various consumer demands. For example, a refrigerator may be designed to additionally have an independent auxiliary storage apparatus (conventionally, referred to as a 'home bar'), which is provided to be exposed to the outside.

With the auxiliary storage apparatus, a user can conveniently store or remove food without opening the refrigerator door.

Conventional auxiliary storage apparatuses are provided with a shelf capable of conveniently storing wine bottles, etc. However, development of an apparatus suitable to efficiently store plural cans is still insufficient. In particular, there exists a need for a receiving apparatus capable of assuring convenient storage and removal of cans without deterioration of space utility despite frequent use of the associated auxiliary storage apparatus.

SUMMARY OF THE INVENTION

Accordingly, the present invention is directed to a can receiving apparatus and a refrigerator having the same that substantially obviate one or more problems due to limitations and disadvantages of the related art.

An object of the present invention is to provide a can receiving apparatus for a refrigerator, which can achieve excellent space utility and assure convenient storage and removal of plural cans in association with the use of another auxiliary storage apparatus.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a can receiving apparatus for a refrigerator comprises: a case; a can receiving shelf coupled to the case in a pivotally rotatable manner; and a holding means to fix the can receiving shelf at an upper limit position upon pivotal rotation of the can receiving shelf.

The holding means may include a holding protrusion provided at one of the case and the can receiving shelf, and a receiving member provided at the other one of the case and the can receiving shelf so as to be coupled with the holding protrusion.

The receiving member may include a pair of receiving ribs having free ends curved towards each other.

Preferably, the receiving ribs are formed at the case, and the case is formed with a guide recess having a bottom surface spaced apart from the free ends of the receiving ribs.

In this case, the receiving ribs may extend to the center of the guide recess.

More preferably, the case is further formed with a receiving recess to fix the can receiving shelf at a lower limit position upon pivotal rotation of the can receiving shelf.

The receiving recess may receive the holding protrusion formed at the can receiving shelf.

Preferably, the receiving recess is formed at a lower end of the guide recess.

The holding protrusion may be provided at either side of the can receiving shelf, and the receiving member may be provided at an inner wall surface of the case.

The case may include an opened front frame, an upper frame, and a pair of side frames.

Preferably, the case further includes a cover to open or close the front frame.

More preferably, the cover is made of a transparent material.

The cover may be perforated in an upper portion thereof with a cover opening for movement of cold air.

The upper frame may be perforated with a frame opening for movement of cold air.

The can receiving shelf may be located at an upper position of the case, and the can receiving shelf may include a front wall portion, a pair of sidewall portions and a bottom portion.

Preferably, the bottom portion is repeatedly formed with a raised portion and a recessed portion, to correspond to a lower contour of a can received on the bottom portion.

More preferably, the recessed portion is perforated with a separating hole to facilitate removal of the can.

Meanwhile, the case may be mounted to a refrigerator door, and preferably, may be provided at an auxiliary storage apparatus.

In accordance with another aspect of the invention, there is provided a refrigerator having a can receiving apparatus, wherein the can receiving apparatus comprises: a case; a can receiving shelf coupled to the case in a pivotally rotatable manner; and a holding means to fix the can receiving shelf when the can receiving shelf is pivotally rotated to an upper limit position thereof, the holding means including a holding protrusion provided at one of the case and the can receiving shelf, and a receiving member provided at the other one of the case and the can receiving shelf so as to be coupled with the holding protrusion.

The receiving member may be formed with a receiving space, into which the holding protrusion is inserted, and an entrance port to be spread outward when the holding protrusion is inserted into the receiving space.

The receiving member may be mounted to a side surface of the case via a fastener.

The receiving member may have a plate form.

The entrance port of the receiving space formed in the receiving member may be spread outward.

The receiving member may be further formed with a shock-absorbing recess connected with the receiving space, the shock-absorbing recess having a size to prohibit insertion of the holding protrusion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
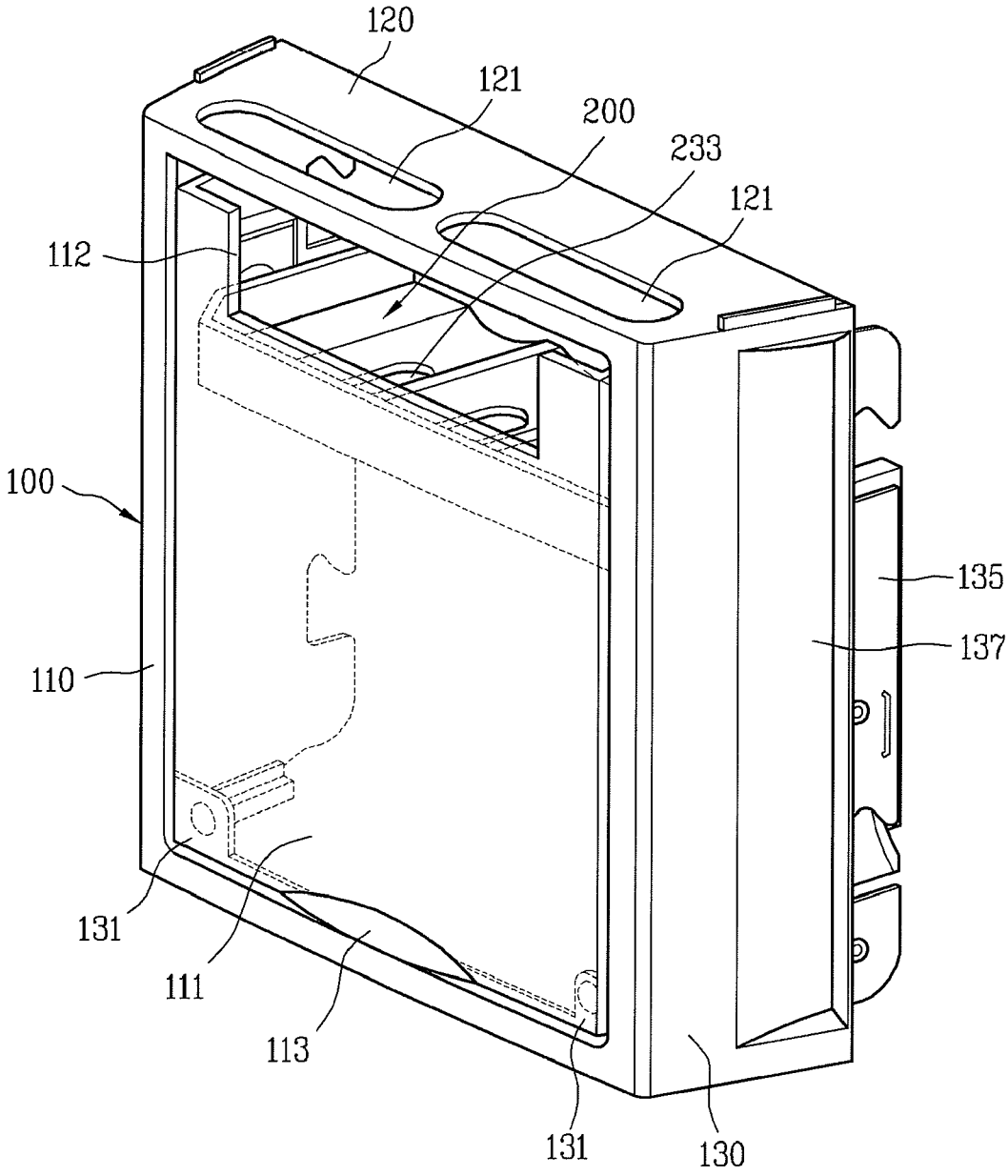
FIG. 1 is a front perspective view illustrating a can receiving apparatus for a refrigerator according to the present invention.
Figure 2:
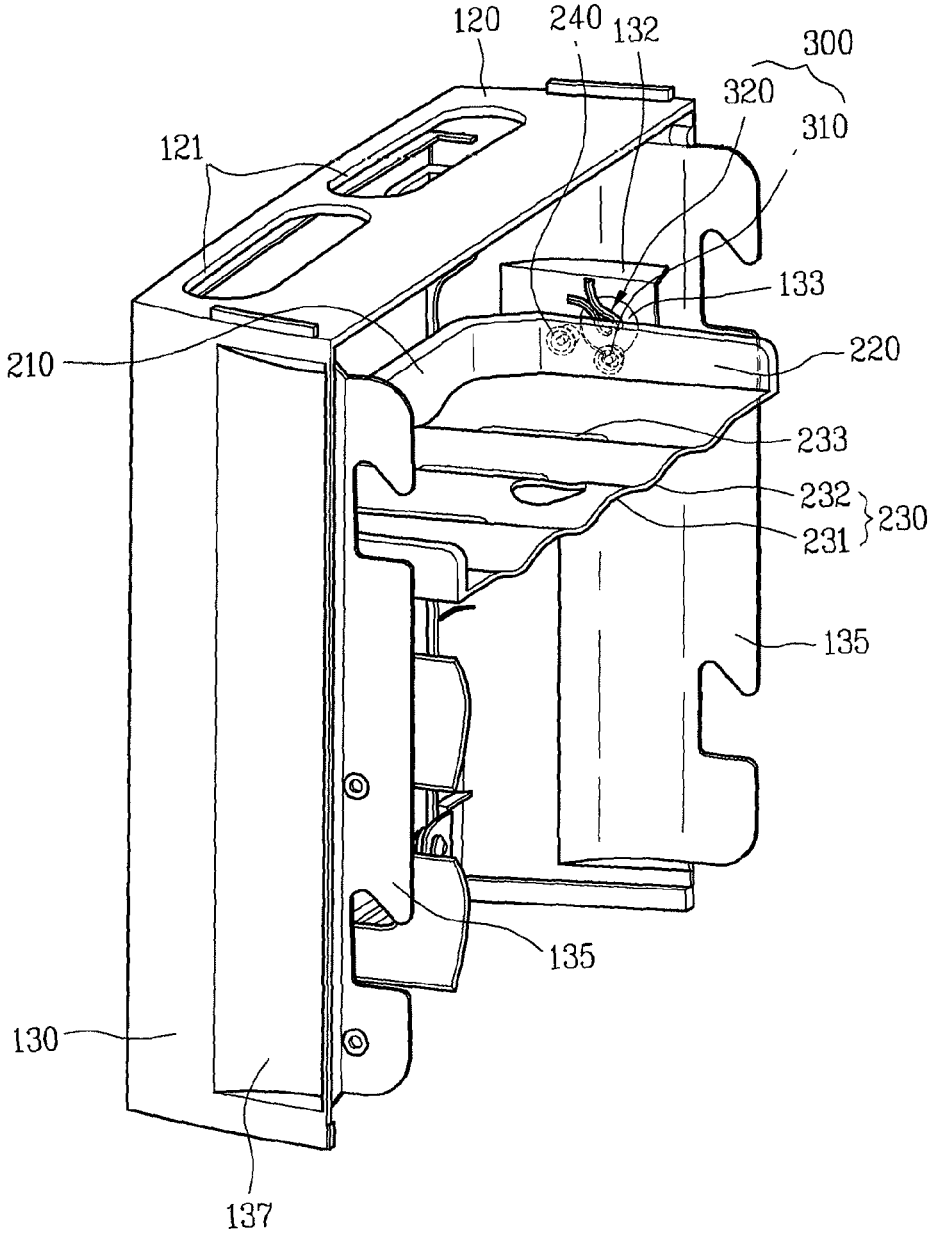
FIG. 2 is a rear perspective view of FIG. 1.

Referring to FIGS. 1 and 2 illustrating a can receiving apparatus for a refrigerator according to the present invention, the can receiving apparatus includes a case 100, a can receiving shelf 200, and holding means 300.

The case 100 is constituted of a rectangular front frame 110 having an opening, an upper frame 120 horizontally extending rearward from an upper end of the front frame 110, and a pair of side frames 130 extending rearward from both sides of the front frame 110.

Both the side frames 130 are obliquely spread outward from the front frame 110 and also, vertically extend downward from the upper frame 120. All of the front frame 110, the upper frame 120 and the side frames 130 define an outer appearance of the case 100.

Each side frame 130 is provided at a rear end thereof with a rearwardly-extending vertical flange 135. The rearwardly-extending vertical flange 135 can be mounted to, for example, an independent auxiliary storage apparatus (not shown) which can allow a user to conveniently store or remove a variety of food without opening a refrigerator door.

The front frame 110 is provided with a cover 111 to open or close the opening of the front frame 110. The cover 111 is hingedly coupled to both the side frames 130, so as to be pivotally rotated up and down along an arc path.

To keep the cover 111 at a fixed vertical position so as to prevent the cover 111 from being further rotated rearward from a pivotally rotated lower-limit position thereof, both the side frames 130 are provided with stoppers 131, respectively. The stoppers 132 extend inward from the side frames 130 toward the center of the case 100.

Preferably, the cover 111 is made of a transparent material to allow the interior of the case 100 to be visible from the outside. The cover 111 is perforated in an upper portion thereof with a rectangular cover opening 112 for easy observation of cans stored on the can receiving shelf 200 and movement of cold air therethrough.

The cover 111 is provided at a lower end thereof with a forwardly-protruding grip 113, to allow a user to pivotally rotate the cover 111 using the grip 113. The forwardly-protruding grip 113 has a relatively recessed rear portion, and the user can easily pull up or push up the grip 113.

The upper frame 120 is perforated with frame openings 121 for movement of cold air. As shown, it is preferred that a plurality of frame openings be perforated parallel to each other to achieve a sufficient flow rate of cold air without deteriorating the strength of the upper frame 120.

Preferably, both the side frames 130 are provided at outer surfaces thereof with outwardly-protruding longitudinal reinforcing pieces 137, respectively, to reinforce the side frames 130.

The can receiving shelf 200 is mounted to an upper position of the case 100 such that it is pivotally rotatable up and down along an arc path. For this, the can receiving shelf 200 is provided at both sides thereof with rotatable protrusions 240, which can be rotatably inserted into a wall surface of the case 100.

The can receiving shelf 200 is constituted of a front wall portion 210, sidewall portions 220 extending rearward from both sides of the front wall portion 210, and a bottom portion 230.

The bottom portion 230 is alternately and repeatedly formed with convexly raised portions 231 and concavely recessed portions 232, which have a gentle curvature to stably store plural cans thereon. The recessed portions 232 serve to retain cans thereon, and the raised portions 231 serve to prevent rolling of the cans.

Each recessed portion 232 is perforated with an elongated separating hole 233, through which the user inserts his/her finger to conveniently push up and remove the can stored on the recessed portion 232.

To prevent the stored can from unintentionally falling from a rear end of the can receiving shelf 200, it is preferred that the bottom portion 230 of the can receiving shelf 200 be normally tilted gradually upwardly and rearwardly. Forward separation of the can is naturally limited by the front wall portion 210 of the can receiving shelf 200.

The holding means 300 serve to fix the can receiving shelf 200 at an upper-limit position upon pivotal rotation of the can receiving shelf 200. Each of the holding means 300 includes a holding protrusion 310 formed at one of the case 100 and the can receiving shelf 200, and a receiving member 320 formed at the other one of the case 100 and the can receiving shelf 200.

Figure 3:
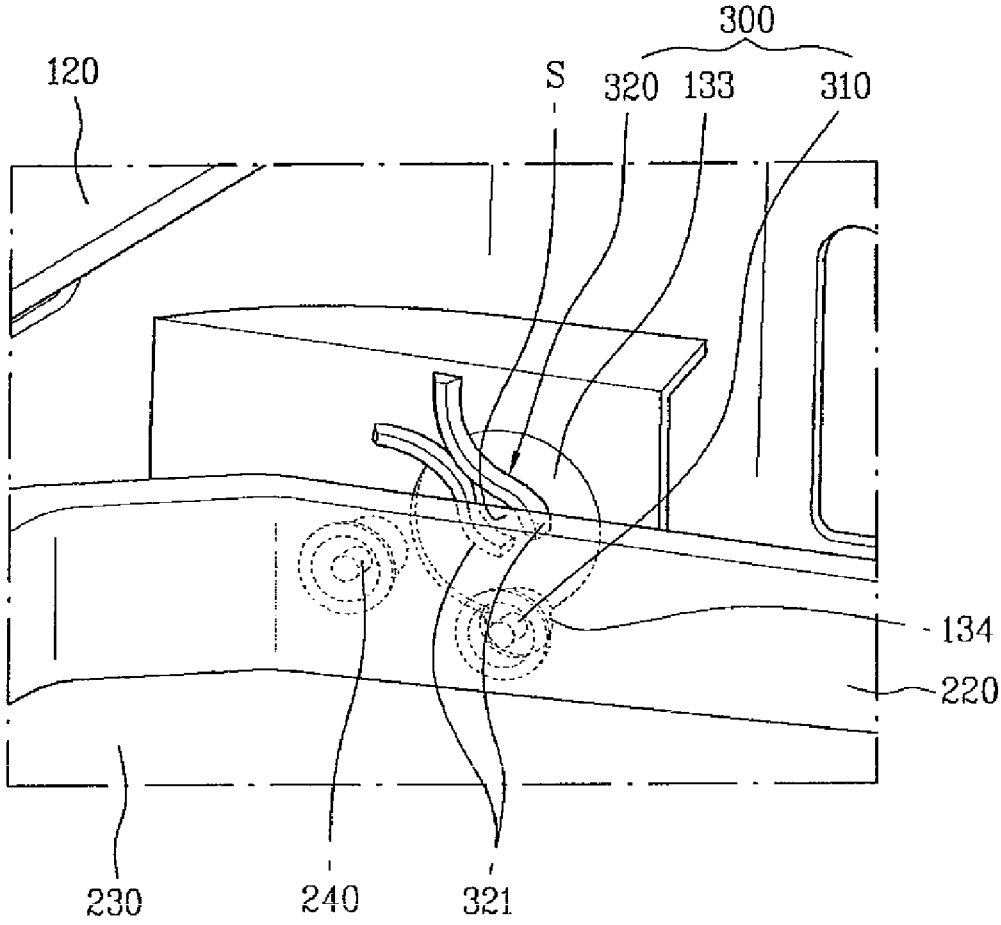
FIG. 3 is a partially enlarged perspective view illustrating a holding means of FIG. 2.

As shown in FIGS. 2 and 3, in an embodiment of the present invention, the holding means 300 includes the holding protrusion 310 formed at the can receiving shelf 200, and the receiving member 320 formed at the case 100 so as to be coupled with the holding protrusion 310.

The holding protrusion 310 is formed at an outer surface of the corresponding sidewall portion 220 of the can receiving shelf 200, to protrude perpendicular to the outer surface of the sidewall portion 220. Preferably, the holding protrusion 310 is provided near a bottom of the rotatable protrusion 240, for efficient fixing and release operations thereof.

The receiving member 320 is formed at the corresponding side frame 130 of the case 100. Here, in consideration of the fact that the side frame 130 extends rearward from the front frame 110 to be spread outward, to allow the receiving member 320 to oppose the holding protrusion 310, the receiving member 320 is formed at a supporting plate 132 protruding inward from an inner surface of the side frame 130.

The inwardly-protruding supporting plate 132 is formed with a circular guide recess 133. In turn, the guide recess 133 is formed at the center of a lower end thereof with a semi-circular receiving recess 134, to fix the holding protrusion 310 at a lower-limit position of the can receiving shelf 200.

The receiving member 320 is formed of a pair of receiving ribs 321 extending from near an upper end of the supporting plate 132 to the center of the guide recess 133. Lower halves of the receiving ribs 321 are spaced apart from the bottom surface of the guide recess 133 to form free ends, and are curvedly away from each other and then, closer to each other.

With this configuration, the pair of receiving ribs 321 defines an approximately circular receiving space S having an entrance port E, through which the holding protrusion 310 can be elastically inserted into the receiving member 320.

Although the present invention describes the receiving member 320 using the pair of receiving ribs 321 as shown, of course, the receiving member 320 may employ various other coupling means so long as the other coupling means can fix the holding protrusion 310 at the upper-limit position or lower-limit position of the can receiving shelf 200.

Now, operational effects of the can receiving apparatus for a refrigerator according to the present invention having the above-described configuration will be described.

When it is desired to store plural cans on the can receiving shelf 200 within the case 100, the cover 111, hingedly coupled to both the side frames 130, is pivotally rotated upward and then, the plural cans are stored in a laid condition on the recessed portions 232 formed at the bottom portion 230 of the can receiving shelf 200.

Figure 4:
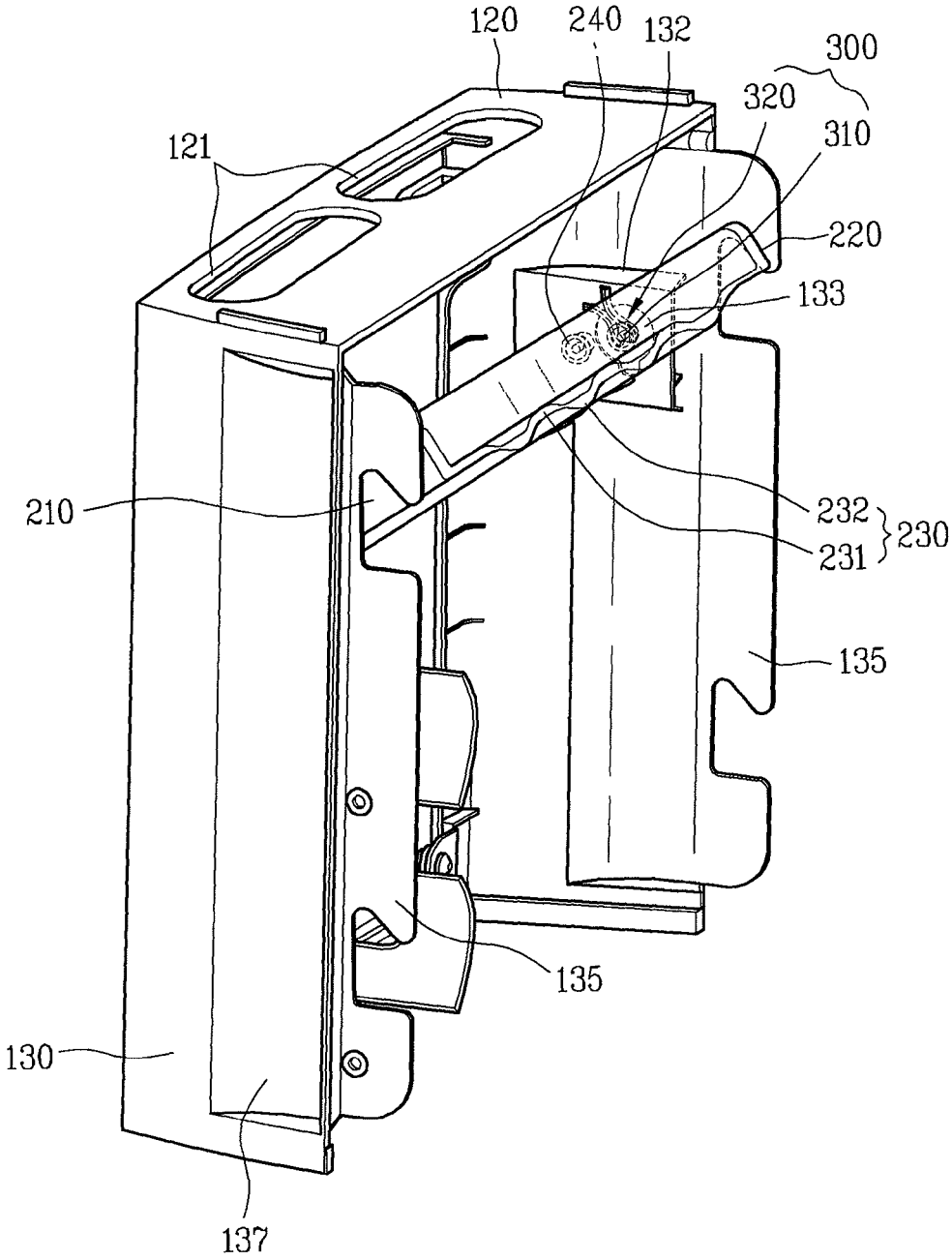
FIG. 4 is a perspective view illustrating the usage of FIG. 2.
Figure 5:
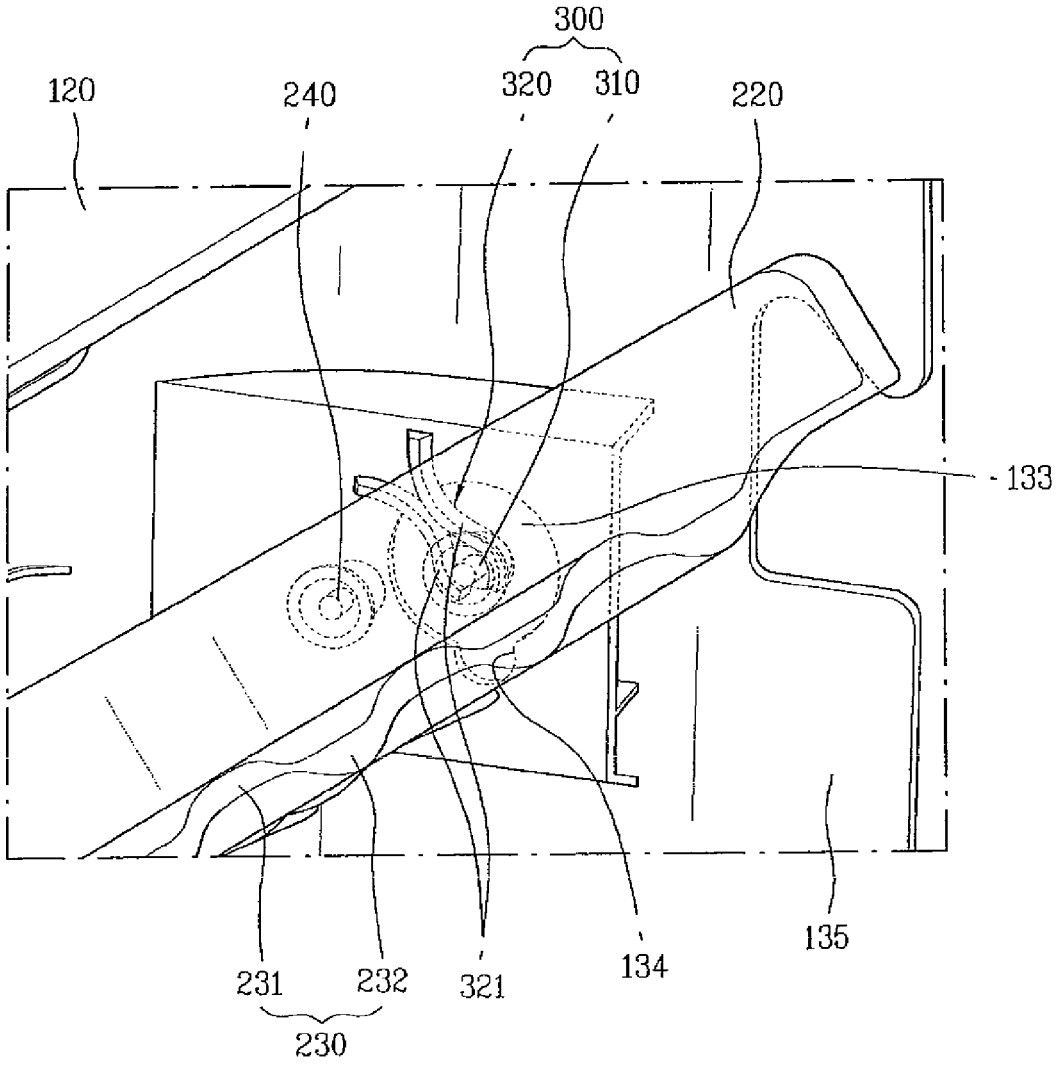
FIG. 5 is a partially enlarged perspective view illustrating a holding means of FIG. 4.

Specifically, for convenience of storage, as shown in FIGS. 4 and 5, after the can receiving shelf 200 is pivotally rotated counterclockwise until it reaches the upper-limit position thereof, the holding protrusion 310, protruding from either sidewall portion 220 of the can receiving shelf 200, is fixedly inserted into the receiving space S of the receiving member 320 defined by the pair of receiving ribs 321.

Thereby, the can receiving shelf 200 can be fixedly kept at a tilted position, and the respective cans can be stably stored on the can receiving shelf 200 at fixed positions. In such a storage state, the rearwardly and upwardly tilted bottom portion 230 of the can receiving shelf 200 can prevent the cans from falling, the repeatedly formed raised portions 231 can prevent the cans from rolling, and the front wall portion 210 can prevent forward separation of the cans.

In particular, as a result of the receiving member 320 being formed of the pair of receiving ribs 321 which have the lower halves spaced apart from the bottom surface of the guide recess 133 to form free ends while being curved away from each other and then being gradually curved closer to each other, the holding protrusion 310 can be elastically inserted into the receiving member 320 and consequently, can maintain a desired coupling force despite frequent use thereof.

Also, when it is desired to remove the cans stored in the tilted state of the can receiving shelf 200, the user simply pushes the cans up with one hand by inserting his/her fingers into the elongated separating holes 233 perforated in the recessed portions 232 and thereafter, can conveniently remove the cans by gripping the pushed cans with the other hand.

On the contrary, when it is desired to return the can receiving shelf 200 to an original position thereof, as shown in FIGS. 2 and 3, the can receiving shelf 200 is pivotally rotated clockwise to the original position, whereby the holding protrusion 310 is separated from the receiving space S of the receiving member 320 and then, is fixedly inserted into the semi-circular receiving recess 134 formed at the lower end of the guide recess 133.

According to the present invention as described above, the can receiving shelf 200 can be stably fixed at the upper-limit position or the lower-limit position upon pivotal rotation thereof, and this assures easy storage and discharge of the cans.

Meanwhile, when the flanges 135 of both the side frames 130 are coupled to, for example, an independent auxiliary storage apparatus installed at the refrigerator door, the can receiving shelf 200 occupies a small volume and allows the user to conveniently store or remove cans without opening the refrigerator door.

Figure 6:
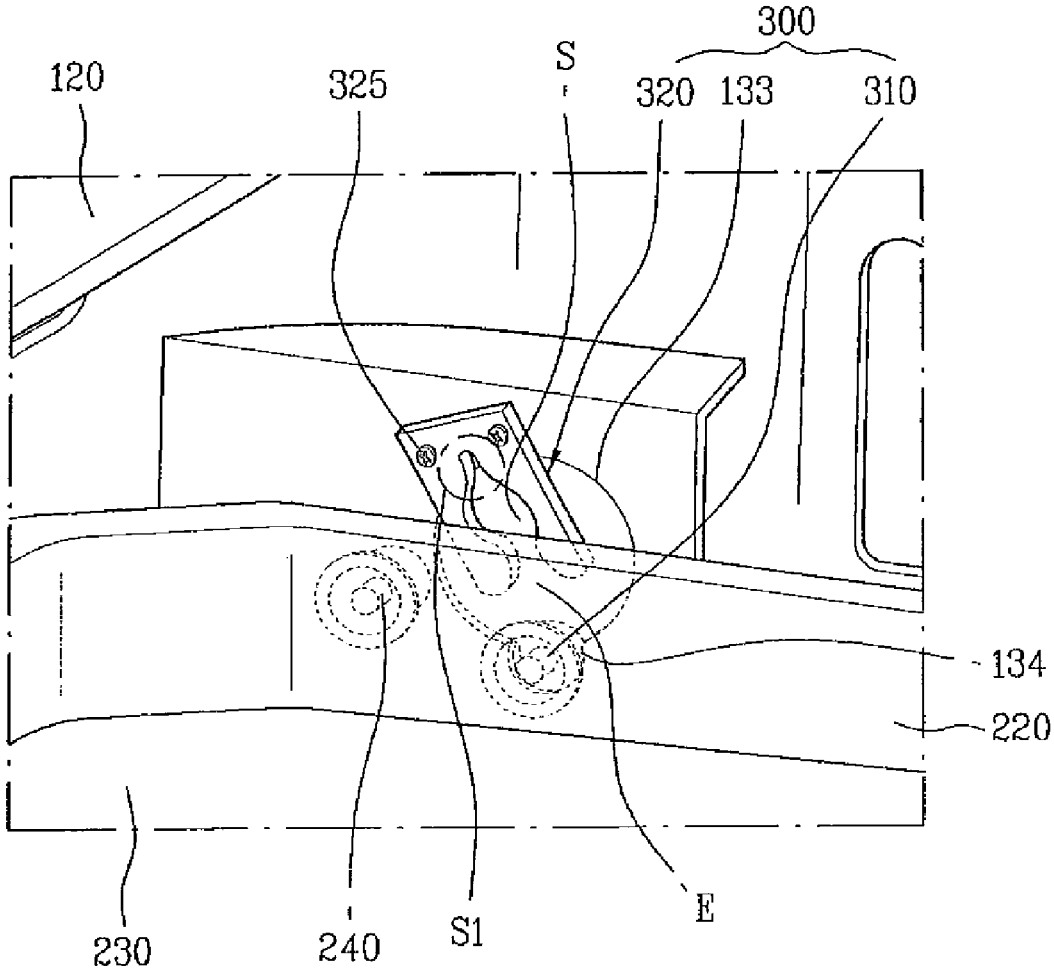
FIG. 6 is a partially enlarged perspective view illustrating a further embodiment of the present invention.

FIG. 6 illustrates a can receiving apparatus according to a further embodiment of the present invention. In the present embodiment, the receiving member 320 may be a single member. As shown in FIG. 6, the receiving member 320 takes the form of a plate, and is centrally formed with the receiving space S into which the holding protrusion 310 is fixedly inserted, in the same manner as the above-described embodiment. The receiving member 320 is mounted to the wall surface of the case 100 by means of fasteners 325.

Similar to the above-described embodiment, the receiving member 320 shown in FIG. 6 is configured such that an entrance port E thereof is spread outward to assure easy insertion of the holding protrusion 310.

The entrance port E preferably has a smaller width than a diameter of the holding protrusion 310.

The receiving member 320 may be made of, for example, plastic or a sufficiently elastic metal. Accordingly, the receiving member 320 can be spread outward upon insertion of the holding protrusion 310. On the other hand, after the holding protrusion 310 is completely inserted into the receiving space S, the receiving member 320 can hold the holding protrusion 310 in place, so as to prevent the holding protrusion 310 from being rotated to a horizontal position upon receiving the weight of the can receiving shelf 200 and the cans stored on the can receiving shelf 200.

With relation to separating the holding protrusion 310 from the receiving space S, it is preferred that the receiving member 302 have a fixing force suitable to allow the holding protrusion 310 to be easily separated from the receiving space S upon receiving a rotational torque applied to the can receiving shelf 200 by the user.

The fixing force of the receiving member 320 may be adjusted by adjusting a size of the entrance port E of the receiving member 320, or by appropriately selecting a constituent material of the receiving member 320.

In the embodiment shown in FIG. 6, the receiving member 320 may further include a shock-absorbing recess S1, which is connected with the receiving space S and has a smaller width than a diameter of the holding protrusion 310. The shock-absorbing recess S1 absorbs collision shock caused as the holding protrusion 310 collides with an inner wall surface of the receiving space S when being seated in the receiving space S.

The width of the shock-absorbing recess S1 is determined so as not to allow insertion of the holding protrusion 310, and the shock-absorbing recess S1 can dampen shock applied to the receiving member 320 by the holding protrusion 310 when the holding protrusion 310 is completely inserted into the receiving space S. Such a shock-absorbing effect may be accomplished by the shape of the receiving ribs 321 shown in FIG. 3. That is, the shock-absorbing effect can be accomplished by the configuration of the receiving ribs 321 in which distal ends of the receiving ribs 321 extend closer to each other after defining the receiving space S.

Specifically, with the above-described configuration of the receiving ribs 321, the receiving member 320 can exert a repulsive force against a force spreading the receiving member 320 outward upon insertion of the holding protrusion 310, thereby achieving smooth operation.

Figure 7:
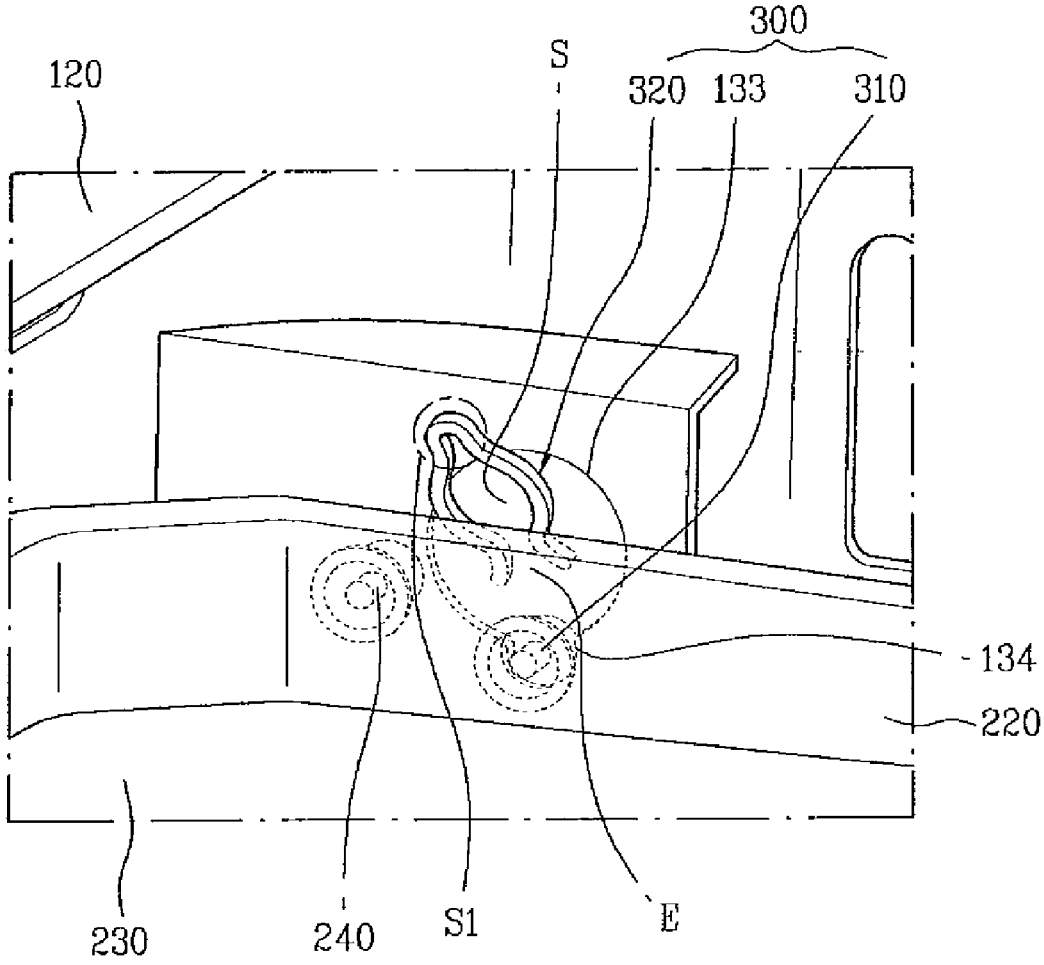
FIG. 7 is a partially enlarged perspective view illustrating a still further embodiment of the present invention.

FIG. 7 illustrates a still further embodiment of the can receiving apparatus according to the present invention. In the present embodiment shown in FIG. 7, the receiving member 320 may take the form of a single wire.

Similar to the above-described embodiment shown in FIG. 6, the receiving member 320 has the shock-absorbing recess S1, which is connected with the receiving space S and has a smaller width than a diameter of the holding protrusion 310.

In the embodiments shown in FIGS. 6 and 7, the entrance port E of the receiving member 320 may be configured to be spread outward. This configuration can smoothly guide insertion of the holding protrusion 310, preventing damage to the receiving member 320 and providing the receiving member 320 with smooth operation.

As apparent from the above description, the present invention provides a can receiving apparatus and a refrigerator having the same, which exhibit the following advantageous effects.

First, according to the present invention, a can receiving shelf included in the can receiving apparatus can be fixed at an upper limit position or a lower limit position upon pivotal rotation thereof while stably supporting cans stored thereon. This assures easy storage and discharge of the cans.

Second, when the can receiving apparatus is mounted to an independent auxiliary storage apparatus installed at a refrigerator door, it is possible to conveniently store or remove plural cans without opening the refrigerator door.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalent.

What is claimed is:

1. A can receiving apparatus for a refrigerator comprising:

a case;

a can receiving shelf coupled to the case in a pivotally rotatable manner with rotatable protrusions provided at both sides of the can receiving shelf and rotatably inserted into a wall surface of the case; and a holding means to hold the can receiving shelf at an upper-limit position upon pivotal rotation of the can receiving shelf, wherein the holding means includes a holding protrusion provided at the can receiving shelf, and a receiving member provided at the case so as to be coupled with the holding protrusion, the receiving member includes a pair of receiving ribs having free ends curved towards each other, and the receiving ribs are formed at the case, and the case is provided with a guide recess formed on the wall surface of the case, the guide recess having a bottom surface spaced apart from the free ends of the receiving ribs so that the free ends of the receiving ribs are spread outward elastically when the holding protrusion is inserted into the receiving ribs to hold the holding protrusion.

2. The apparatus according to claim 1, wherein the receiving ribs extend to the center of the guide recess.

3. The apparatus according to claim 1, wherein the case is further formed with a receiving recess to fix the can receiving shelf at a lower-limit position upon pivotal rotation of the can receiving shelf.

4. The apparatus according to claim 3, wherein the receiving recess receives the holding protrusion formed at the can receiving shelf.

5. The apparatus according to claim 3, wherein the receiving recess is formed at a lower end of the guide recess.

6. The apparatus according to claim 1, wherein the holding protrusion is provided at either side of the can receiving shelf, and the receiving member is provided at an inner wall surface of the case.

7. The apparatus according to claim 1, wherein the case includes an opened front frame, an upper frame, and a pair of side frames.

8. The apparatus according to claim 7, wherein the case further includes a cover to open or close the front frame.

9. The apparatus according to claim 8, wherein the cover is made of a transparent material.

10. The apparatus according to claim 8, wherein the cover is perforated in an upper portion thereof with a cover opening for movement of cold air.

11. The apparatus according to claim 7, wherein the upper frame is perforated with a frame opening for movement of cold air.

12. The apparatus according to claim 1, wherein the can receiving shelf is located at an upper position of the case.

13. The apparatus according to claim 1, wherein the can receiving shelf includes a front wall portion, a pair of sidewall portions and a bottom portion.

14. The apparatus according to claim 13, wherein the bottom portion is repeatedly formed with a raised portion and a recessed portion, to correspond to a lower contour of a can received on the bottom portion.

15. The apparatus according to claim 14, wherein the recessed portion is perforated with a separating hole for removal of the can.

16. The apparatus according to claim 1, wherein the case is mounted to a refrigerator door.

17. The apparatus according to claim 16, wherein the case is provided at an auxiliary storage apparatus.

18. A refrigerator having a can receiving apparatus, wherein the can receiving apparatus comprises:

a case;

a can receiving shelf coupled to the case in a pivotally rotatable manner with rotatable protrusions provided at both sides of the can receiving shelf and rotatably inserted into a wall surface of the case; and a holding means to hold the can receiving shelf when the can receiving shelf is pivotally rotated to an upper-limit position thereof, the holding means including a holding protrusion provided at one of the case and the can receiving shelf, and a receiving member provided at the other one of the case and the can receiving shelf so as to be coupled with the holding protrusion, wherein the receiving member is formed with a receiving space, into which the holding protrusion is inserted, and an entrance port to be spread outward elastically when the holding protrusion is inserted into the receiving space to hold the holding protrusion.

19. The refrigerator according to claim 18, wherein the receiving member is mounted to an inner wall surface of the case via a fastener.

20. The refrigerator according to claim 18, wherein the receiving member has a plate form.

21. The refrigerator according to claim 18, wherein the entrance port of the receiving space formed in the receiving member is spread outward.

22. The refrigerator according to claim 18, wherein the receiving member is further formed with a shock-absorbing recess connected with the receiving space, the shock-absorbing recess having a size to prohibit insertion of the holding protrusion.

* * * * *